US011459857B2

(12) United States Patent
Al-Anazi et al.

(10) Patent No.: US 11,459,857 B2
(45) Date of Patent: Oct. 4, 2022

(54) MANAGING WATER INJECTED INTO A DISPOSAL WELL

(71) Applicant: Saudi Arabian Oil Company, Dhahran (SA)

(72) Inventors: Ammal F. Al-Anazi, Dammam (SA); James Arukhe, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 46 days.

(21) Appl. No.: 17/140,270

(22) Filed: Jan. 4, 2021

(65) Prior Publication Data

US 2022/0213762 A1 Jul. 7, 2022

(51) Int. Cl.
*E21B 34/02* (2006.01)
*E21B 41/00* (2006.01)
*E21B 43/34* (2006.01)

(52) U.S. Cl.
CPC ..... *E21B 41/0057* (2013.01); *E21B 34/02* (2013.01); *E21B 43/34* (2013.01)

(58) Field of Classification Search
CPC .... E21B 34/02; E21B 34/025; E21B 41/0057; E21B 43/34; E21B 43/40
See application file for complete search history.

(56) References Cited

U.S. PATENT DOCUMENTS 6,823,271 B1 11/2004 Foss
8,372,248 B1 2/2013 Sherry
8,641,813 B2 2/2014 Gysling
2012/0168364 A1 7/2012 Evans
2013/0313191 A1* 11/2013 Wolf ..... C02F 9/00 210/638
2017/0183244 A1* 6/2017 Eriksson ..... B01D 17/12
2017/0349455 A1 12/2017 Katz
2020/0139266 A1* 5/2020 Daasvatn ..... B01D 19/0042
2020/0240255 A1* 7/2020 Forthuber ..... C10G 31/10
2020/0378234 A1* 12/2020 Daasvatn ..... B01D 17/06

FOREIGN PATENT DOCUMENTS

WO WO-2020080951 A1 * 4/2020 ..... B01D 17/0205

* cited by examiner

*Primary Examiner* — Matthew R Buck
(74) *Attorney, Agent, or Firm* — Fish & Richardson P.C.

(57) ABSTRACT

Techniques for managing water disposal include circulating a mixed water-oil liquid in a pipeline from a water-oil separation plant toward at least one disposal well that includes a wellbore formed from a terranean surface to a subterranean formation; determining, based on a sampling of the mixed water-oil liquid by an OIW meter, an amount of oil in the mixed water-oil liquid; based on the amount of oil being within a desired amount range: controlling each a choke valve and a surface safety valve to modulate toward an open position, and controlling a recycle valve to modulate to a closed position; and based on the amount of oil being outside of the desired amount range: controlling the choke valve and the surface safety valve to modulate toward a closed position, and controlling the recycle valve to modulate to an open position.

21 Claims, 9 Drawing Sheets

700

| Time (hour) | Time (s) | Oil ppm | Oil Percent (%) | Water (%) |
|---|---|---|---|---|
| 0 | 0 | 50,000 | 5 | 95 |
| 5 | 18000 | 40,000 | 4 | 96 |
| 6 | 21600 | 30,000 | 3 | 97 |
| 7 | 25200 | 20,000 | 2 | 98 |
| 8 | 28800 | 10,000 | 1 | 99 |
| 9 | 32400 | 8,000 | 0.8 | 99.2 |
| 10 | 36000 | 6,000 | 0.6 | 99.4 |
| 11 | 39600 | 4,000 | 0.4 | 99.6 |
| 12 | 43200 | 2,000 | 0.2 | 99.8 |
| 13 | 46800 | 1,000 | 0.1 | 99.9 |
| 14 | 50400 | 900 | 0.09 | 99.91 |
| 15 | 54000 | 800 | 0.08 | 99.92 |
| 16 | 57600 | 700 | 0.07 | 99.93 |
| 17 | 61200 | 600 | 0.06 | 99.94 |
| 18 | 64800 | 500 | 0.05 | 99.95 |
| 19 | 68400 | 400 | 0.04 | 99.96 |
| 20 | 72000 | 300 | 0.03 | 99.97 |
| 21 | 75600 | 200 | 0.02 | 99.98 |
| 22 | 79200 | 100 | 0.01 | 99.99 |
| 23 | 82800 | 90 | 0.009 | 99.991 |
| 24 | 86400 | 80 | 0.008 | 99.992 |
| 25 | 90000 | 70 | 0.007 | 99.993 |
| 26 | 93600 | 60 | 0.006 | 99.994 |
| 27 | 97200 | **50** | **0.005** | **99.995** |
| 28 | 100800 | 40 | 0.004 | 99.996 |
| 29 | 104400 | 30 | 0.003 | 99.997 |
| 30 | 108000 | 20 | 0.002 | 99.998 |
| 31 | 111600 | 10 | 0.001 | 99.999 |

FIG. 7

MANAGING WATER INJECTED INTO A DISPOSAL WELL

TECHNICAL FIELD

The present disclosure describes apparatus, systems, and methods for managing water injected into a disposal well.

BACKGROUND

Water disposal networks are both a crucial and an integral part of a mature oil production system for several fields. Both a water disposal network and an oil production system must co-exist without the possibility of eliminating or restricting either oil production or water disposal. The oil production rates that a specific field can attain depends, in some aspects, on the health of the water disposal network, which can include one or more water disposal wells. Consequently, water disposal wells can become a bottleneck that governs whether operators can achieve maximum sustainable oil production rates at high oil demand periods. With rising water cuts (in other words, higher percentage of water mixed with oil) from mature wells draining active water drive reservoirs, it is often critical to handle the resulting water production from gas and oil separation plants on a continuous basis, through maintaining adequate disposal capacity into disposal wells with permeable reservoirs.

SUMMARY

In an example implementation, a water disposal system includes a piping circuit configured to circulate a mixed water-oil liquid from a water-oil separation plant to at least one water disposal well, the at least one water disposal well including a wellbore formed from a terranean surface to a subterranean formation; an oil-in-water (OIW) meter positioned in the piping circuit between the water-oil separation plant and the at least one water disposal well; at least one recycle valve positioned in the piping circuit downstream of the OIW meter; at least one choke valve positioned in the piping circuit between the OIW meter and a wellhead of the at least one water disposal well; at least one surface safety valve positioned at the wellhead; and a control system communicably coupled to the OIW meter, the at least one recycle valve, the at least one choke valve, and the at least one surface safety valve. The control system is configured to perform operations including determining, based on a sampling of the mixed water-oil liquid by the OIW meter, an amount of oil in the mixed water-oil liquid; based on the amount of oil being within a desired amount range, controlling each of the at least one choke valve and the at least one surface safety valve to modulate toward an open position or to maintain the open position, and controlling the at least one recycle valve to modulate to a closed position or to maintain the closed position; and based on the amount of oil being outside of the desired amount range, controlling each of the at least one choke valve and the at least one surface safety valve to modulate toward a closed position or to maintain the closed position, and controlling the at least one recycle valve to modulate to an open position or to maintain the open position.

In an aspect combinable with the example implementation, the control system is configured to perform operations further including providing, to a supervisory control and data acquisition system of the water-oil separation plant, one or more signals representative of at least one of the determined amount of oil in the mixed water-oil liquid; or a position status of at least one of the at least one choke valve, the at least one surface safety valve, or the at least one recycle valve.

In another aspect combinable with any of the previous aspects, the control system is configured to perform operations further including providing an alarm to the supervisory control and data acquisition system of the water-oil separation plant based on the determined amount of oil in the mixed water-oil liquid being outside of the desired amount range.

Another aspect combinable with any of the previous aspects further includes at least one pump fluidly coupled between the at least one recycle valve and the water-oil separation plant.

In another aspect combinable with any of the previous aspects, the control system is configured to perform operations further including controlling the at least one pump to circulate the mixed water-oil liquid through the at least one recycle valve to the water-oil separation plant based on the at least one recycle valve modulated to the open position or maintained at the open position.

In another aspect combinable with any of the previous aspects, the OIW meter is positioned within 100 meters of the water-oil separation plant.

In another aspect combinable with any of the previous aspects, the open position is 100% open, and the closed position is 100% closed.

In another aspect combinable with any of the previous aspects, the desired amount range is between 0% and 0.5% oil by volume in the mixed water-oil liquid.

In another example implementation, a method for managing water disposal includes circulating a mixed water-oil liquid in a pipeline from a water-oil separation plant toward at least one disposal well that includes a wellbore formed from a terranean surface to a subterranean formation. The pipeline includes an oil-in-water (OIW) meter positioned in the pipeline between the water-oil separation plant and the at least one water disposal well, at least one recycle valve positioned in the pipeline downstream of the OIW meter, at least one choke valve positioned in the pipeline between the OIW meter and a wellhead of the at least one water disposal well, and at least one surface safety valve positioned at the wellhead. The method further includes determining, based on a sampling of the mixed water-oil liquid by the OIW meter, an amount of oil in the mixed water-oil liquid; based on the amount of oil being within a desired amount range: controlling each of the at least one choke valve and the at least one surface safety valve to modulate toward an open position or to maintain the open position, and controlling the at least one recycle valve to modulate to a closed position or to maintain the closed position; and based on the amount of oil being outside of the desired amount range: controlling each of the at least one choke valve and the at least one surface safety valve to modulate toward a closed position or to maintain the closed position, and controlling the at least one recycle valve to modulate to an open position or to maintain the open position.

An aspect combinable with the example implementation further includes providing, to a supervisory control and data acquisition system of the water-oil separation plant, one or more signals representative of at least one of: the determined amount of oil in the mixed water-oil liquid; or a position status of at least one of the at least one choke valve, the at least one surface safety valve, or the at least one recycle valve.

Another aspect combinable with any of the previous aspects further includes providing an alarm to the supervisory control and data acquisition system of the water-oil separation plant based on the determined amount of oil in the mixed water-oil liquid being outside of the desired amount range.

Another aspect combinable with any of the previous aspects further includes controlling at least one pump fluidly coupled between the at least one recycle valve and the water-oil separation plant to circulate the mixed water-oil liquid from the at least one recycle valve to the water-oil separation plant based on the at least one recycle valve modulated to the open position or maintained at the open position.

In another aspect combinable with any of the previous aspects, the OIW meter is positioned within 100 meters of the water-oil separation plant.

In another aspect combinable with any of the previous aspects, the open position is 100% open, and the closed position is 100% closed.

In another aspect combinable with any of the previous aspects, the desired amount range is between 0% and 0.5% oil by volume in the mixed water-oil liquid.

Another aspect combinable with any of the previous aspects further includes sampling the mixed water-oil liquid in the pipeline between the at least one recycle valve and the at least one choke valve.

In another example implementation, a computer-implemented method includes identifying, with a computing system that includes one or more hardware processors, a value of an amount of oil in a mixed water-oil liquid that is circulating from a water-oil separation plant to at least one disposal wellbore; determining, with the computing system, that the value is within an acceptable range of values; based on the determination that the value is within the acceptable range of values, operating, with the computing system, each of at least one choke valve and at least one surface safety valve to modulate toward an open position or to maintain the open position, and at least one recycle valve to modulate to a closed position or to maintain the closed position; based on the determination that the value is within the acceptable range of values, operating, with the computing system, at least one pump to circulate the mixed water-oil liquid into the at least one disposal wellbore; determining, with the computing system, that the value is outside of the acceptable range of values; based on the determination that the value is outside of the acceptable range of values, operating, with the computing system, each of the at least one choke valve and the at least one surface safety valve to modulate toward a closed position or to maintain the closed position, and the at least one recycle valve to modulate to an open position or to maintain the open position; and based on the determination that the value is outside of the acceptable range of values, operating, with the computing system, at least one pump to circulate the mixed water-oil liquid from the at least one recycle valve to the water-oil separation plant.

In an aspect combinable with the example implementation, the open position is 100% open, and the closed position is 100% closed.

In another aspect combinable with any of the previous aspects, the acceptable range is between 0% and 0.5% oil by volume in the mixed water-oil liquid.

Another aspect combinable with any of the previous aspects further includes operating, with the computing system, an oil-in-water (OIW) meter to sample the mixed water-oil liquid.

In another aspect combinable with any of the previous aspects, the operating of the OIW meter is repeated periodically.

Implementations of a water disposal system according to the present disclosure can include one or more of the following features. For example, a water disposal system according to the present disclosure can eliminate or help eliminate damage to a geologic formation targeted for the injected water. As another example, a water disposal system according to the present disclosure can ensure or help ensure an integrity of the formation in terms of permeability and porosity (the parameters controlling flow through the formation). By reducing the formation damage, a water disposal system according to the present disclosure can minimize the formation treatment frequency wherein acid and organic solvents treatments may apply to restore the integrity and injectivity of the formation (with such treatments costing millions of dollars on a yearly basis to remove the damage induced by oil mixed in with the disposed water). Further, a water disposal system according to the present disclosure can eliminate or help eliminate manual interference to collect fluid samples and analyze for an amount of oil-in-water, as, in some aspects, oil-in-water measurements and actions to detect the increase in the water stream can occur online (for example, automatically). A water disposal system according to the present disclosure can represent savings in transportation costs required to truck away, handle, and dispose of the produced water from active oil wells within the network. A water disposal system according to the present disclosure can also result in substantial savings from cost avoidance associated with setting up elaborate systems required for recycling wastewater from oil and gas operations. Some of these cost savings include, for example, storage, hauling, transfer, pre-treatment, and treatment. A water disposal system according to the present disclosure can also provide relative time-saving, safety and environmental friendliness through eliminating trucking and the accompanying road traffic, noise pollution, and emissions.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIG. 7 is a table that illustrates certain parameters of a water disposal process according to the present disclosure.

DETAILED DESCRIPTION

Figure 1A:
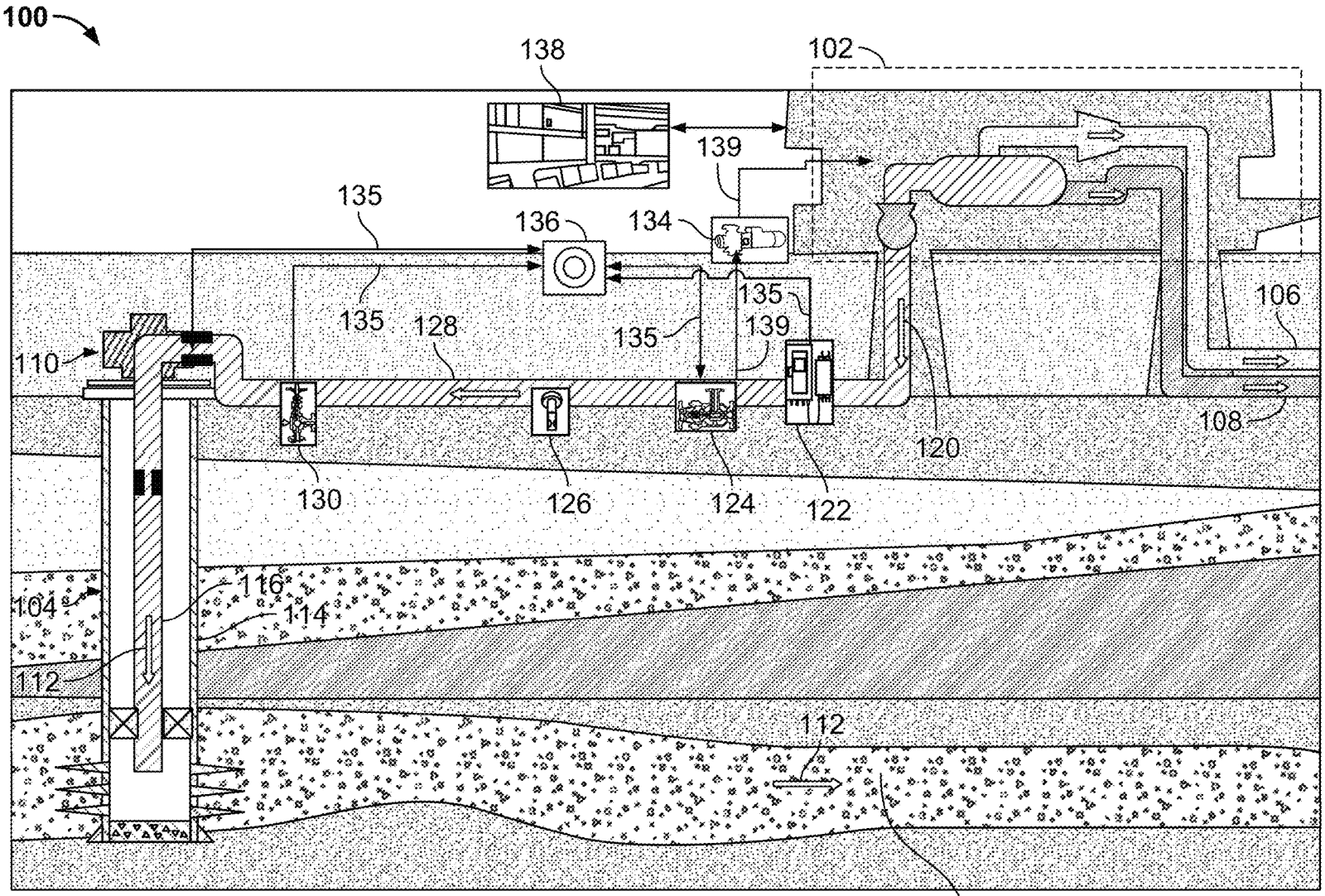
FIGS. 1A-1B are schematic diagrams of a water disposal system according to the present disclosure.
Figure 1B:
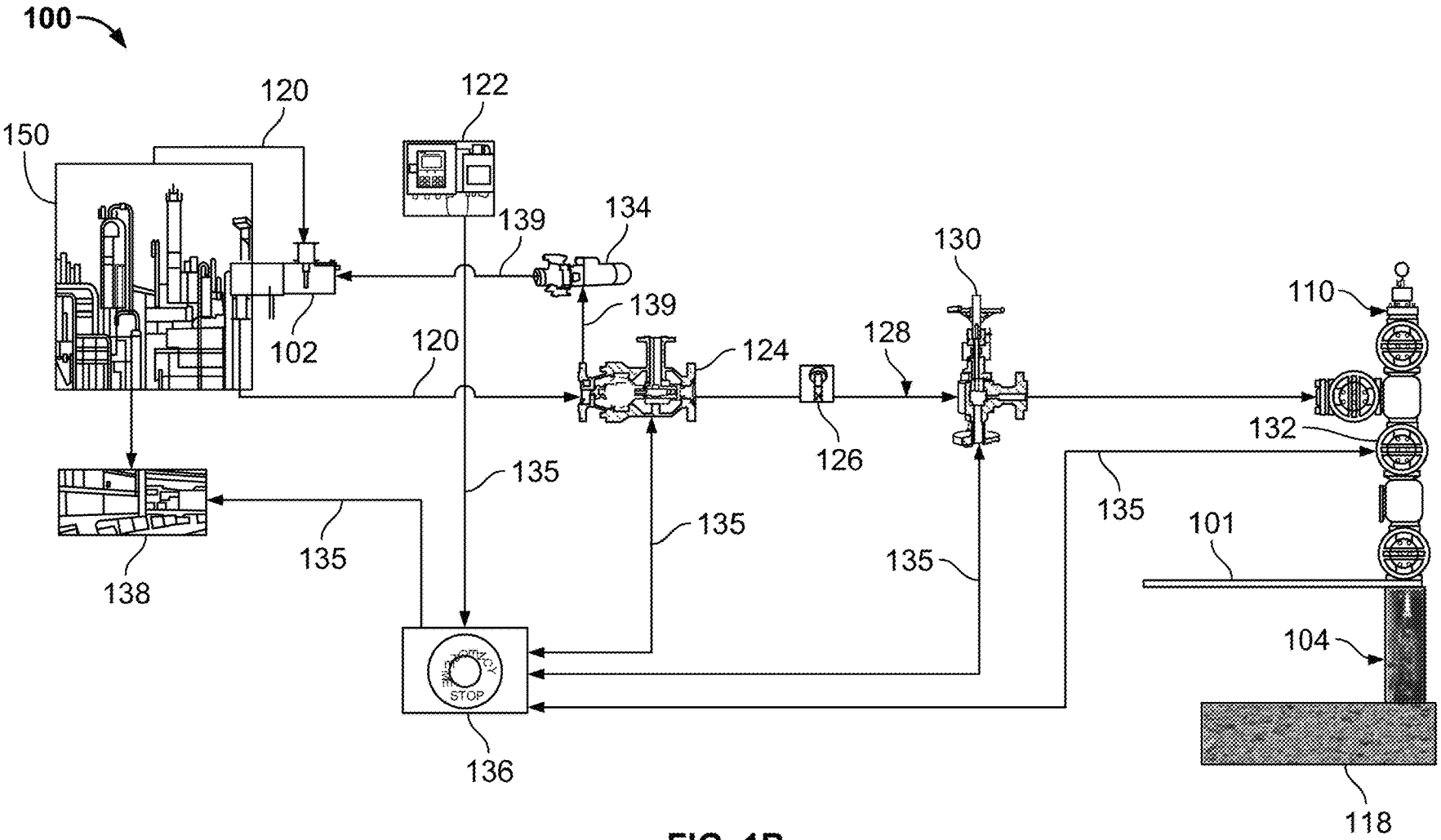

FIGS. 1A-1B are schematic diagrams of a water disposal system 100 according to the present disclosure. As shown in FIGS. 1A-1B, water disposal system 100 can, generally, provide for a complete or total removal of water from a hydrocarbon fluid (for example, oil, gas, or a combination thereof) in order for the removed water to be disposed of in a wellbore fluidly coupled to a subterranean formation. Water disposal, in some aspects, can be part of a hydrocarbon production system or other industrial process in which water is a byproduct and must be disposed of, such as the industrial process 150 shown in FIG. 1B (which includes, for instance, a hydrocarbon production process, such as an oil or gas well or wells). Such water (for example, disposal water 112) can be disposed of in one or more disposal wells, such as disposal well 104. As shown, disposal well 104, in this example, includes a wellbore 114 formed from a terranean surface 101 (on land or under a body of water) to a subterranean formation 118 through a tubular 116 (for example, production tubing or casing).

Disposal water 112, conventionally, is separated from a hydrocarbon fluid (oil, gas, or mixture thereof) at a water-oil separation plant (WOSP) 102. Generally, a liquid that includes a mixture of water and hydrocarbon fluids (for example, liquid and/or gas) is provided from the industrial process 150 to the WOSP 102 in order for water (all or most) to be separated from the hydrocarbon fluid(s).

In an example, an example WOSP 102 can process a particular multiphase grade of oil, e.g., Arab heavy oil from one or more fields, while processing of another grade, for example, Arab medium oil from another field can also occur at the WOSP 102 (or another plant). The resulting disposed stream (in other words, of formation water) from one or more WOSPs goes to a utility plant (for example, industrial process 150) for further treatment. A corrugated plate interceptor (CPI) at the utility plant processes the water to remove oil and suspended solids by the gravity difference principle. Thereafter, processing of the resulting fluid occurs through dissolved gas flotation (DGF) equipment at the WOSP 102, to reduce a maximum salt and oil in the water before temporary storage in formation water tanks. At the WOSP 102, monitoring is via analyzers, which ensure the limit threshold for salt and oil-in-water are, for example, 10 lb/1000 bbls and less than 50 ppm, respectively. Fluid that meets the criteria for salt and oil-in-water content then transfers into the formation water tanks.

Additional parameters to monitor for improved disposal water quality assurance/quality control (QA/QC) include pH, salinity, total iron from rusts or products of corrosion, and total suspended solids. Injection pumps (shown in FIG. 1A) then inject water 120 from the WOSP 102 into a pipeline 128 (or piping system 128) for later disposal in one or more disposal wells 104 (for example, at an injection pressure between 800 to 1300 psi). If the water 120 leaving the WOSP 102 does not meet the desired ranges of established pH, total iron, oil-in-water content, and/or total suspended solids can have a higher propensity to result in damage to the subterranean formation 118 (for example, in zones of reduced permeability).

The water 120 can further deteriorate as it travels from the WOSP 102 to the one or more disposal wells 104, picking up scaly materials such as sulfates and calcium carbonates, as well as corrosion products like sulfides, carbonates, sulfates, and iron oxides. Handling the disposed water 120 can become of more importance especially when producing a hydrocarbon reservoir at a maximum sustained capacity of the WOSP 102 (in other words, at a maximum rate at which the WOSP 102 can separate the water from the produced hydrocarbons). During such periods of high demand, compromised retention efficiency could sometimes result in higher than normal residual oil content in the treated water 120 as it makes it way to the disposal wells 104. Unusual spikes in oil-in-water content increase the propensity for asphaltenes and other heavy branched chain hydrocarbons to bridge and block native pore spaces in the subterranean formation 118 into which the disposal wells 104 are formed, as precipitates easily form around the near wellbore. In addition, solids also penetrate the pore spaces of the formation 118 to block and/or bridge pore spaces. Ensuring adequate water disposal capacity of the subterranean formation 118 on a continuous basis can be challenging, such as, because of injectivity decline from water quality issues and because of problems arising from surface and subsurface problems traceable to individual wells.

Wells within an injection (or disposal) well system can experience severe and fast injectivity decline mainly because of formation damage from unusually high spikes in oil-in-water content of the disposed water 112. Spot samples collection manually at the discharge of the industrial process 150 and at the intake of the disposal wells 104 often confirm abnormal residual oil in the water 112 for disposal. The atypical high oil-in-water fluid is susceptible to picking up debris such as iron particles, loose sand, etc. before depositing such debris on the sand face of the injector (disposal) wells. In some aspects, at pH greater than 2, loose iron sulfide in lateral lines tend to precipitate in wastewater pH of about 6.5, while iron hydroxide may precipitate at pH more than 7.0. The result of these precipitations and intermixing with sulfate ions and higher than normal oil-in-water content in the wastewater, among other impurities, is formation damage in the disposal wells and corrosion in the flow lines and well tubulars. Significant pressure drop at the near wellbore during routine injection, often equates to substantial formation damage and high skin in the injection wells, which is often confirmed through fall-off tests but also usually evident on surface through higher than normal injection wellhead pressures. When one or more wells in the injection network suffers significant damage, active monitoring of these wells through continuous parametric measurements becomes necessary to guarantee available disposal capacity. When adequate capacity for water disposal is at risk, stimulation treatments of the damaged wells become critical to maintain oil production and to ensure the injection wells can safely dispose the treated water 112.

A particular problem is a rapid loss in disposal well capacity because of undetected high levels of oil-in-water content and several impurities in produced water. High residual oil in treated water mixes with other chemicals, salts, sand and solids to form sludge, which creates significant formation damage on the wells and corrosion on the pipelines and completion. Treated water transport of the by-products from corrosion to the wells eventually results in bridging and blocking of the native porosity of the disposal wells. Solids invasion and bridging are additional impairment mechanisms. Produced water sample tests have also revealed the presence of anaerobic bacteria that thrive in oxygen deficient environments to produce sulfate-reducing bacteria, which severely corrode and cause leaks in well tubulars and flow lines.

Manual sampling is labor intensive and routine as both field and engineering personal must collect water samples and send these to the laboratory for oil-in-water content analysis every month or quarter as a QA/QC measure. The time cycles between wellhead sampling, laboratory analysis, and implementing remedial action are often relatively long and impractical from a problem detection and resolution perspective standpoint. Often, before any action to fix the problem occurs, the disposal wells often lose injectivity and require considerable operational expenditure to restore disposal capacity.

Previous examination of bailed samples has revealed up to 38% hydrocarbons on sediments containing scale (sulfates and calcium carbonates) and other corrosion products (sulfides, carbonates, sulfates and iron oxides). The complex combination of oil residue trapped in these materials generate flow impediments around the critical matrix of the formation or within the sand face. The high oil-in-water content becomes the glue for binding the iron sulfate, iron oxide, chemicals, salts, and solids, which intermix to severely damage the disposal wells. Several efforts to apply existing solutions involving mud acid, organic, and HCl systems for treating damaged disposal wells have yielded mixed outcomes.

Figure 3:
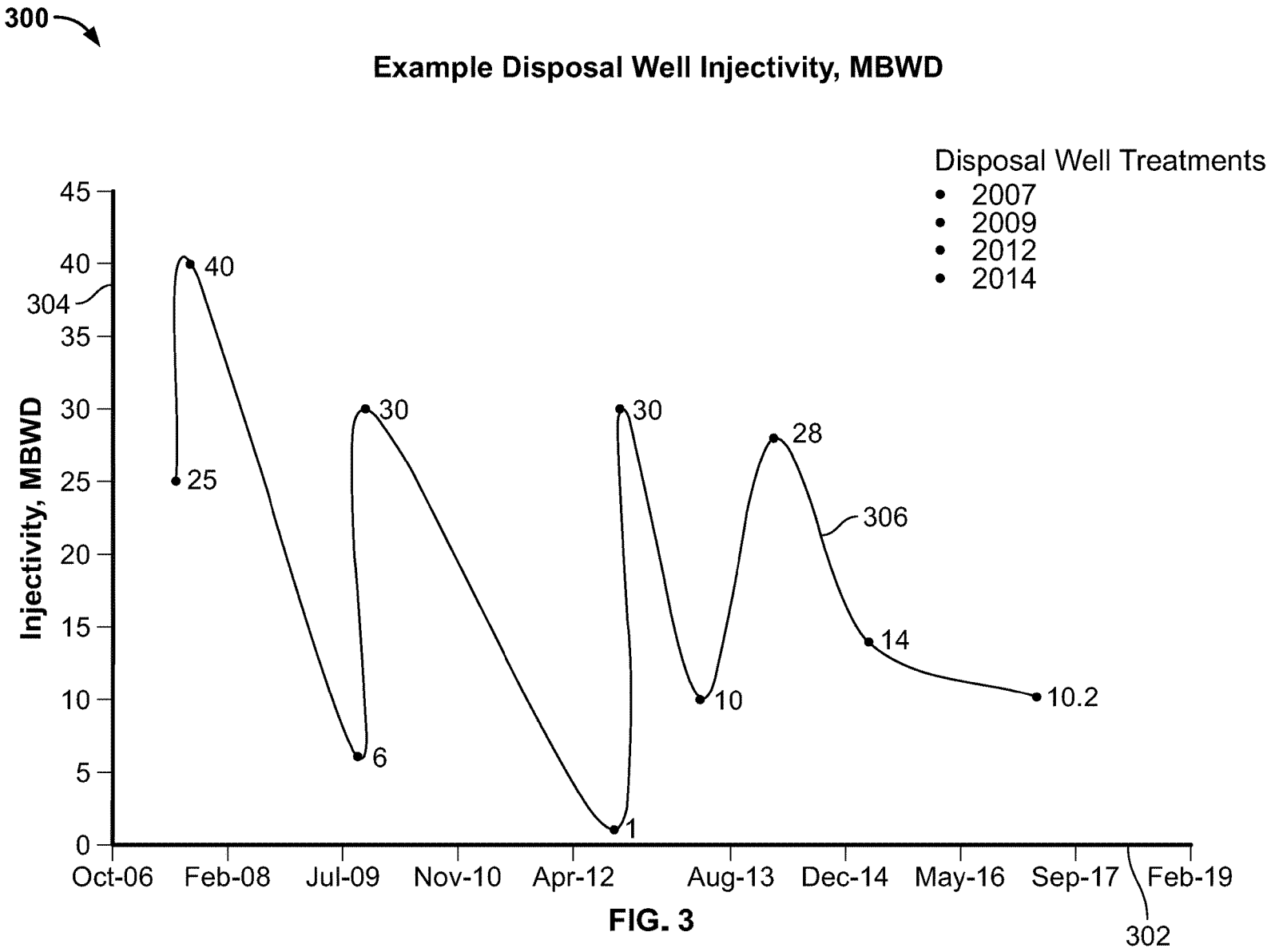
FIG. 3 is a chart that illustrates a water disposal process in a disposal well over time according to the present disclosure.

Such problems that lead to decreased permeability within a reservoir into which water is injected (for example, disposed) can be graphically illustrated in the graph 300 shown in FIG. 3. For example, graph 300 includes an x-axis 302 that represents time (in months) and a y-axis 304 that represents injectivity of disposal water in thousands of barrels of water per day (MWPD). A curve 306 tracks volume of injected water from a typical disposal well into a particular reservoir over time. Thus, curve 306 shows a historical performance of a typical well within a water disposal network. Within a decade under review, four stimulation treatments were conducted on the well. The earliest recorded treatment restored injectivity from 25 MBWD to 40 MBWD. Nevertheless, the well's injectivity sharply dropped to about 6 MBWD. A subsequent treatment in 2009 improved the well's injectivity to 30 MBWD but not to its pre-treatment level prior to 2007. Similar trends occur between successive treatments and the well's last recorded performance The present disclosure, and in particular the example implementation of the water disposal system 100, describe an integrated system of control and monitoring that incorporates the use of multi-purpose oil-in-water meters at the well level resolves several QA/QC issues associated with routine wellhead sampling is described. Manual wellhead sampling may be necessary to monitor the quality of water for disposal by ensuring an acceptable level of oil-in-water content and contaminants are present. Monitoring the performance of the disposal wells through parametric measurements is another type of monitoring. These manual measurements are common to provide disposal well monitoring and some level of comfort. Nevertheless, with considerable high rates, it is commonplace to continue experiencing higher than normal oil-in-water levels and contaminants in the disposal water despite frequent sampling, and the use of field level oil-in-water analyzers. The resulting disposal water quality have proven injurious to disposal wells and creates a challenge with the field's capacity to handle water from the plant system without interrupting the production cycle through frequent and increased operational expenses from frequent stimulation treatments. An integrated system of monitoring and control as described in the present disclosure, which includes the use of one or more oil-in-water meters, can represent a lower investment capital option than conducting regular disposal well treatments or even upgrading the existing facilities. Remote control and monitoring can also be advantageous in terms of field efficiency, minimized health and safety risks, as well as reduced operating expenditure.

The water disposal system 100 shown in FIGS. 1A-1B describe an adaptive integrated oil-in-water disposal system. Such a system (as described in more detail herein) offers continuous or semi-continuous oil-in-water monitoring, while eliminating physical or labor-intensive interference to collect and analyze wellhead samples for residual oil-in-water prior to disposal in one or more wells. In some aspects, a multipurpose sensor/meter to monitor chemicals, salts, sand, suspended solids and oil-in-water content is upstream of the adaptive recycle valve, for example, at a relatively close distance (100 m) to the WOSP 102. Online oil-in-water measurements and actions to detect an increase of foreign materials in the water stream occurs automatically or semi-automatically. The result is to improve management of produced water 120 and the quality of the water 120 for disposal into one or more disposal wells 104.

Oil-in-water meters, in some aspects of water disposal system 100, can connect to a Supervisory Control and Data Acquisition (SCADA) System at the well level to enable online monitoring as early as possible, so that production personnel can recycle disposal water to the WOSP 102 during plant upsets or power dip and report the recycled parameters in a report for commitment and tracking purposes. Also, the integrated system can log and store data of oil content information for a particular time duration, for example, up to 18 months (adjustable). The adaptive and integrated system can provide better disposal fluid processing and surveillance for uninterrupted functioning of the production system. Further, the integrated system described in the present disclosure provides for a proactive measurement, monitoring and control within a disposal well network. With the system in operation, for example (and described in more detail later), reactive and choke valves operations and settings reduce, especially as a residual oil-in-water content approaches the maximum allowable. Thus, example implementations of the integrated system can function by implementing and integrating monitoring and control, where close monitoring of the amount of oil-in-water metering occurs online, with a control system that adaptively responds to the measured oil-in-water content. The online metering and control system assures little to no injection of water that fails to meet an acceptable range. The robust adaptive system eliminates or greatly reduces any possibility of injecting out-of-range water into the formation 118 that can cause casing damage and result in partial or total loss of disposal well injectivity.

As shown in more detail in FIGS. 1A-1B, the WOSP 102 includes a separator (SEPARATOR) that separates water from oil and gas. Gas is compressed with one or more compressors (COMPRESSOR) and circulated into a gas line 106. Oil is circulated to an oil line 108. One or more pumps (PUMP) circulate the separated water 120 into the pipeline 128.

As shown in FIGS. 1A-1B, the pipeline 128 includes, downstream of the PUMP, an oil-in-water (OIW) meter 122 that samples the water 120 within the pipeline 128. Also, a separate manual sampling location 126 for taking manual samples of the water 120 is located downstream of the ARV 124. The OIW meter 122, generally, determines a volumetric content of oil within the water 120 (which, downstream of the WOSP 102, can still include oil). The OIW meter 122, in some aspects, can also measure and/or determine other chemicals or contaminants in the water 120 beyond just oil content. In some aspects, there may be multiple OIW meters 122 such that at least two layers of protection can address oil-in-water content concerns to minimize injection of off-specification water. In such aspects, redundant oil-in-water meters (for example, placed at an inlet of the WOSP 102 and at a wing valve of the wellhead 110) can be included in the water disposal system 100 and communicably coupled to the ESD 136. In some aspects, a minimum of two oil-in-water meters can provide continuous oil-in-water measurements at least two locations, for example, after the WOSP 102 and before the disposal well 104.

Downstream of the OIW meter 122 and installed in the pipeline 128 is an adaptive recycle valve (ARV) 124. As shown in FIGS. 1A-1B, the ARV 124 is fluidly coupled in the pipeline 128 to the WOSP 102 through the OIW meter 122 and the PUMP, and is also fluidly coupled to the WOSP 102 through a recycle pump 134 and recycle conduit 139.

Downstream of the ARV 124 and the manual sampling location 126 and installed in the pipeline 128 is an adaptive choke valve (ACV) 130. Although a single ACV 130 (and single ARV 124) is shown in these figures, there may be two or more ACVs 130 (and two or more ARVs 124) in the water disposal system 100.

Downstream of the ACV 130 is a wellhead 110 installed on the disposal well 104. The wellhead 110, generally, comprises multiple flow control devices, such as valves of various types, sensors, and meters. For example, the wellhead 110 may include a crown valve, a wing valve, and a manual master valve (not specifically labeled). The pipeline 128, for instance, may terminate at a wing valve. A surface safety valve (SSV) 132, in this example, is positioned in the wellhead 110 between a wing valve (into which the pipeline 128 terminates) and a manual master valve that is located at a terranean surface 101. In this example, the SSV 132 can be a hydraulically operated valve.

As shown in FIGS. 1A-1B, an Emergency Shutdown System (ESD) 136 (for example, a control system 136) is part of the water disposal system 100 and communicably coupled to one or more of the described components through communications 135 (wired or wireless). In some aspects, the ESD 136 comprises a microprocessor based control system that implements and executes instructions encoded on tangible, non-transitory media to perform one or more algorithms to operate all or a part of the water disposal system 100. In this example implementation, the ESD 136 is communicably coupled through communications 135 (which can be commands sent from the ESD 136 and/or data received at the ESD 136) to the OIW meter 122, ARV 124, the ACV 130, and the SSV 132. For example, the ESD 136 can receive data from the OIW meter 122 (for example, measurements of a volumetric content of oil in the water 120 or other contaminants in the water 120) and provide commands to the ARV 124, the ACV 130, and the SSV 132 (for example, command to close or open, or to modulate toward a closed position or to an open position, or to hold at a particular position). Thus, in some aspects, the ESD 136 can control the ARV 124, the ACV 130, and the SSV 132 to adjust to a certain percentage open (0-100%) or a certain percentage closed (0-100%).

As further shown in FIGS. 1A-1B, the ESD 136 is also communicably coupled to the SCADA 138 (as part of the WOSP 102) to provide data to the SCADA 138 regarding, an amount of oil in the water 120, positions of the ARV 124, the ACV 130, and the SSV 132, and other data. Thus, in an example operation of the water disposal system 100, water 120 leaving an industrial process 150 passes through the WOSP 102, where it is treated to remove the maximum chemicals, salts, sand, suspended solids and oil-in-water to acceptable QA/QC criteria (for example, pH, salinity, etc.). Treated produced water 120 of acceptable standard (for example, as determined by the OIW meter 122 and the ESD 136) then passes through the ARV 124, the ACV 130, and through the SSV 132 to the disposal well 104. The ESD 136 can trigger an alarm if the OIW meter 122 senses that the oil amounts in the water 120 is unacceptable. What follows the alarm can be a complete shutdown of the disposal well system through closing the SSV 132 and flow recycled water 120 to the WOSP 102 for further processing. This workflow results in reducing the oil-in-water content in the treated water 120 to an allowable value fit for safe injection into the disposal well 104.

The ESD 136, through its operating algorithm ESD logic, reads the online OIW meter 122 input, compares the input with a predefined acceptable range and provides an output instruction to the SSV 132, the ACV 130, and the ARV 124. The ESD 136 connects to the SCADA 138 in the WOSP 102, where an operator can track the entire water disposal system 100 system. Unacceptable treated water relative to the set QA/QC criteria results in the system triggering an alarm as the ESD 136 sends a signal to SSV 132 to shut down the disposal well 104. Concurrently, the ESD 136 can signal also cause the flow to bypass the ACV 130, but allow the ARV 124 to recycle the flow back to the WOSP 102 for further treatment until the water 120 for disposal is of the proper quality.

Figure 2:
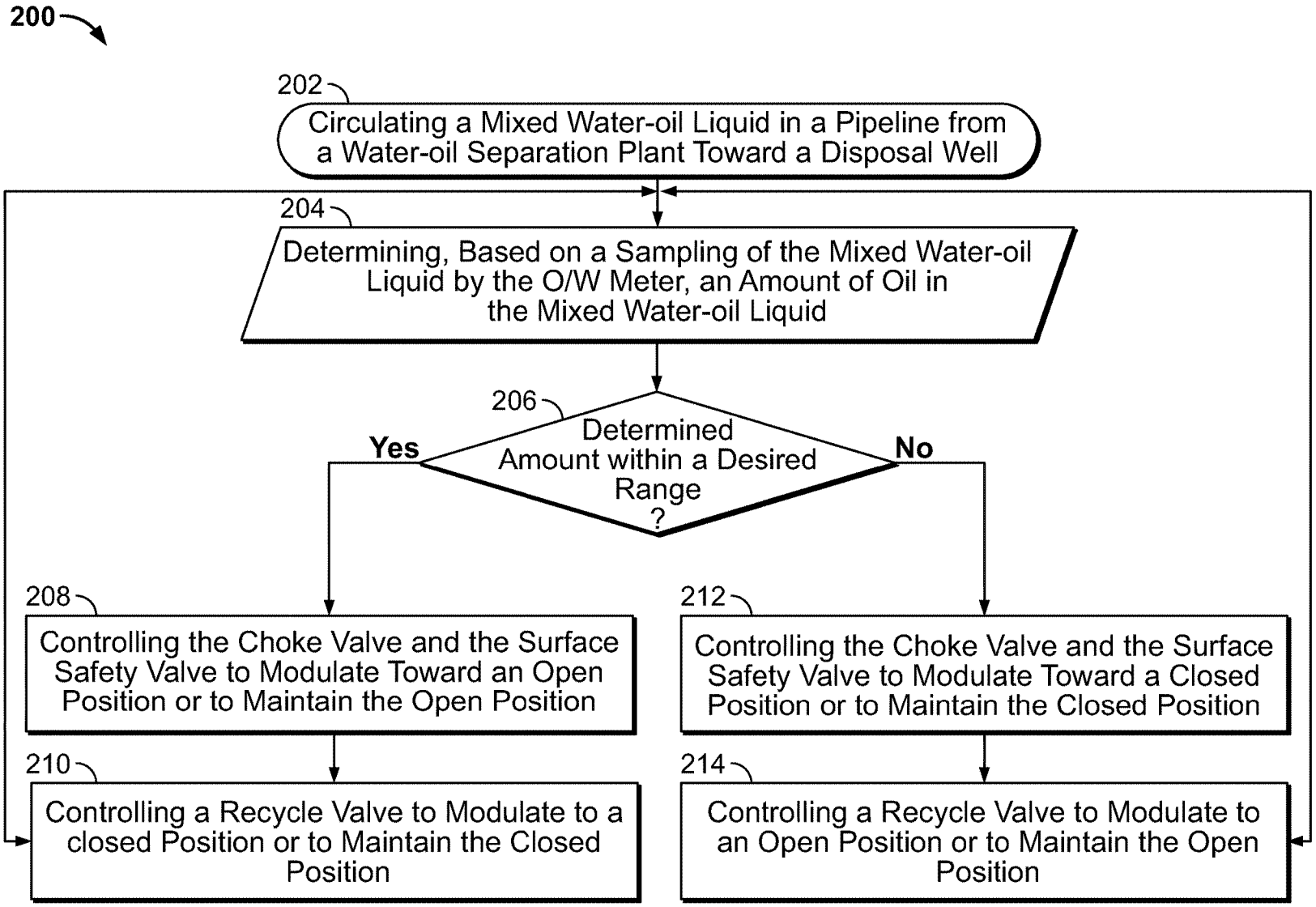
FIG. 2 is a flowchart that illustrates an example process of a water disposal system according to the present disclosure.

FIG. 2 is a flowchart that illustrates an example process 200 of a water disposal system. In some aspects, process 200 can be implemented by the water disposal system 100 and, more particularly, the ESD 136 in combination with the components of the water disposal system 100. Process 200 can begin at step 202, which includes circulating a mixed water-oil liquid in a pipeline from a water-oil separation plant toward a disposal well. For example, the mixed water-oil liquid (for example, water 120), once treated by the WOSP 102, is circulated (for example pumping) through the pipeline 128 toward the disposal well 104.

Process 200 can continue at step 204, which includes determining, based on a sampling of the mixed water-oil liquid by an OIW meter, an amount of oil in the mixed water-oil liquid. For example, as the water 120 passes through the OIW meter 122, the meter 122 measures an amount of oil in the water 120. In some aspects, the OIW meter 122 (or other sensor or meter) can also measure an amount of other contaminants in the water 120. The oil measurement in the water 120 is provided to or identified at the ESD 136.

Process 200 can continue at step 206, which includes determining whether the determined amount is within a desired range. For example, the ESD 136 can compare the determined amount of oil in the water 120 (as measured by the OIW meter 122) to a desirable range (for example, between 0-0.5% oil by volume). The ESD 136 can also compare an amount of measured contaminants in the water 120 measured by the OIW meter 122 (or another sensor or meter) to a desirable ranch of such contaminants.

Based on a yes determination in step 206, process 200 can continue at step 208, which includes controlling a choke valve and a surface safety valve to modulate toward an open position or to maintain the open position. For example, the ESD 136 signals each of the ACV 130 and the SSV 132 to modulate toward an open position (for example, 100% open).

Process 200 can continue at step 210, which includes controlling a recycle valve to modulate to a closed position or to maintain the closed position. For example, the ESD 136 signals the ARV 124 to modulate toward a closed position (for example, 100% closed). Thus, based on a yes determination, if the oil-in-water content falls within the acceptable range, the ESD 136 sends a signal to the surface safety valves and both the adaptive and recycle valves to allow the treated water pass through the valves into the water disposal well 104.

Based on a no determination in step 206, process 200 can continue at step 212, which includes controlling the choke valve and the surface safety valve to modulate toward a closed position or to maintain the closed position. For example, the ESD 136 signals each of the ACV 130 and the SSV 132 to modulate toward a closed position (for example, 100% closed).

Process 200 can continue at step 214, which includes controlling a recycle valve to modulate to an open position or to maintain the open position. For example, the ESD 136 signals the ARV 124 to modulate toward an open position (for example, 100% open). Thus, based on a no determination, if the oil-in-water content falls beyond the pre-defined acceptable range, the system can trigger an alarm as the ESD 136 sends a signal to hydraulic surface safety valve to shut down the disposal well 104. Simultaneously (or serially), the ESD 136 can signal to bypass the adaptive choke valve; but to open fully the recycle valves; to recycle the flow back to the WOSP 102 for further treatment so that the oil-in-water content can reduce to the allowable range before disposal in the well 104.

Figure 4:
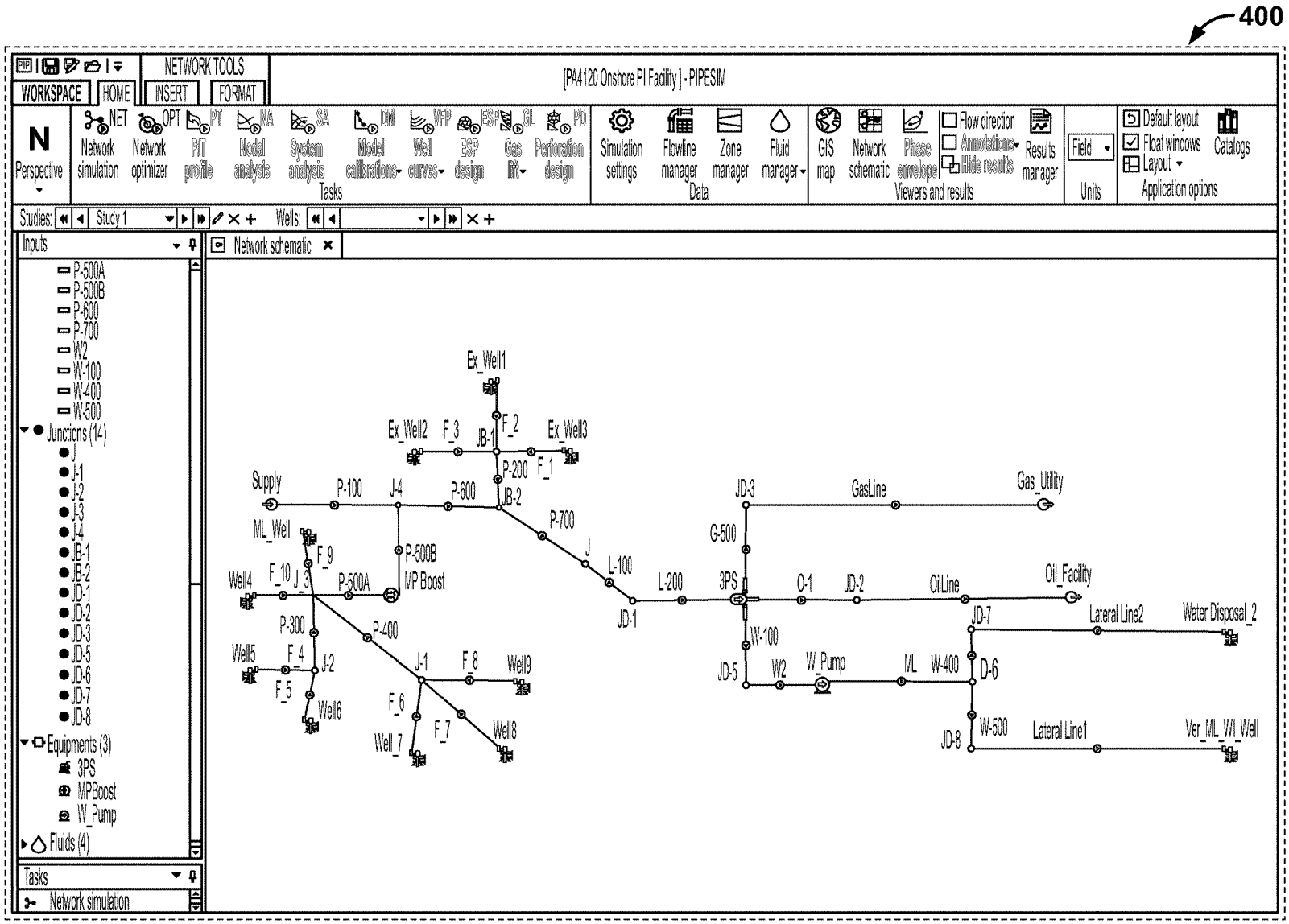
FIG. 4 illustrates an example computer model of a water disposal system according to the present disclosure.

FIG. 4 illustrates an example computer model 400 of a water disposal system according to the present disclosure. For example, construction of a snapshot model 500 of the overall production injection network (for example, water disposal system 100) was constructed using the PIPESIM software, a physics correlation software that models pressure drop, provided by Schlumberger having headquarters in Houston, Tex., USA. However, the water-recycling problem addressed by implementations of the water disposal system 100 is a transient one involving a gas and oil separation network, with a water/oil separation plant/injection manifold (WOSP 102), an adaptive recycle valve, adaptive choke, and an injector with a hydraulic surface valve equipped wellhead. Generation of the transient model uses a time-dependent software that simulates transient flow, with OLGA software provided by Schlumberger having headquarters in Houston, Tex., USA. OLGA allows the model setup as a closed cycle, using controllers and conditional valves that would open/closed given the oil-in-water content threshold. User defined components in the model include the Emergency Shut Down System (ESD) 136, including a Supervisory Control and Data Acquisition (SCADA) system 138.

Figure 5:
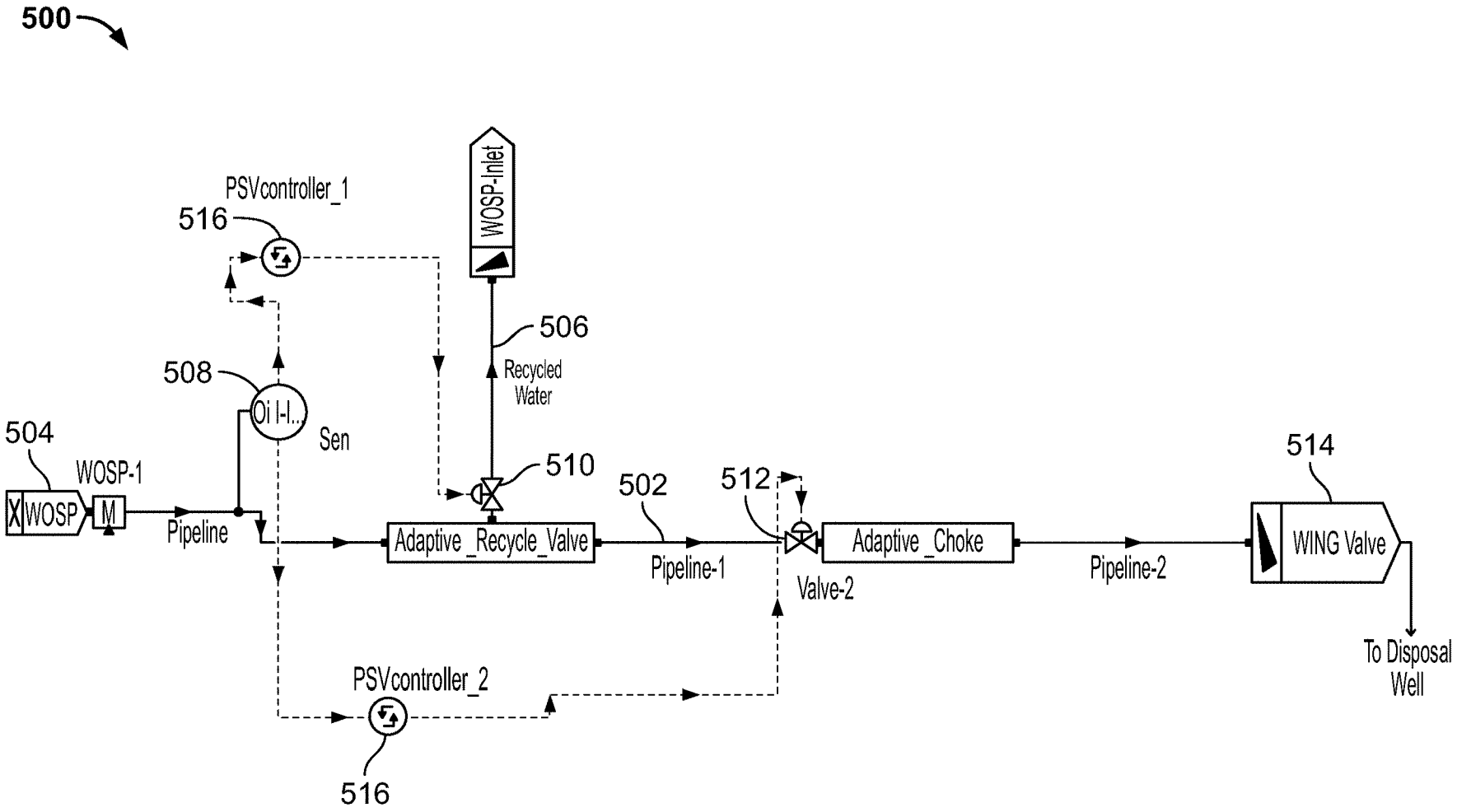
FIG. 5 illustrates an example schematic model of a water disposal system according to the present disclosure.

FIG. 5 illustrates an example schematic model 500 of a water disposal system according to the present disclosure. More specifically, the schematic model 500 is a transient model using OLGA software provided by Schlumberger having headquarters in Houston, Tex., USA. The model 500 shows the treated water leaving the water and oil separation plant (WOSP) 504 (which may be similar or identical to WOSP 102) that treats the water to take out the most amount of foreign chemicals, salts, sand, suspended solids and oil-in-water content possible. A, for example, 10" pipeline 502 conveying the treated water out of the plant 504 has a multipurpose sensor/meter 508 to monitor chemicals, salts, sand, suspended solids and oil-in-water content. The model 500 is set-up to process water with considerable initial oil-in-water content greater than 50 ppm beyond 27 hours processing period. The model 500 is set up for 20,000 BWPD processing from the WOSP 504 of 100 psig operating pressure, 50 ppm oil-in-water threshold, and 1,500 psig injection wellhead pressure at the disposal well. The oil-in-water meter 508 is upstream of an adaptive recycle valve 510, at a particular distance (for example, 100 m) to the WOSP 504, such that a pump is not required to divert water with oil-in-water content exceeding the set threshold, for further processing. The model 500 shows the recycle valve 510 can send the process fluid 506 back to WOSP 504 without the need of a pump in this model example.

To predict the major conditions of the operations relating to transient flow in the model 500, a 50 ppm oil-in-water threshold was programmed into controllers 516 to open or close an adaptive choke valve 512 and the adaptive recycle valve 510 at the set point. If the oil-in-water content is greater than 50 ppm, the PSV Controller_1 (516) ensures flow of the recycled water 506 back to the WOSP 504 for further produced water treatment through the action of the adaptive recycle valve 510. If the sensor 508 senses that the quality of water entering it is unacceptable, it causes the ESD to trigger an alarm and close a wellhead hydraulic surface safety valve (not shown in the model 500), which promptly shuts down the disposal well at the wing valve 514 to prevent any injection.

The iterative workflow results in reducing the oil-in-water content in the treated water to an allowable value. Nevertheless, at 27 hours of processing, the oil-in-water content is less than 50 ppm, PSV Controller_2 (516) ensures flow through an open adaptive choke valve 512 to allow injection into the wellhead through the wing valve 514 and into the disposal well. The time series of events including the pressure at the WOSP 504, controller actions for the valve manipulations to mimic the dynamic passage of treated 20,000 bbls/day produced water containing 0.010%, 0.005% oil-in-water, 0.003%, 0.002% and 0.001% oil-in-water content (i.e. to represent 100 ppm, 50 ppm, 30 ppm, 20 ppm, and 10 ppm oil-in-water) are as provided in table 700 of FIG. 7. Maximum pressure at the WOSP 504 is 1507 psi. Opening of the adaptive recycle valve 510 and the adaptive choke valve 512 is a function of water-cut. At approximately 28.04 hours, both adaptive recycle valves and adaptive valves are partially open at: 22.18% and 77.82% respectively at a corresponding water-cut of 99.9981225% or 18.78-ppm oil-in-water content; and 58.1% and 41.9% respectively at a corresponding water-cut of 99.9952793121338% or 47.21 ppm oil-in-water content.

Figure 6A:
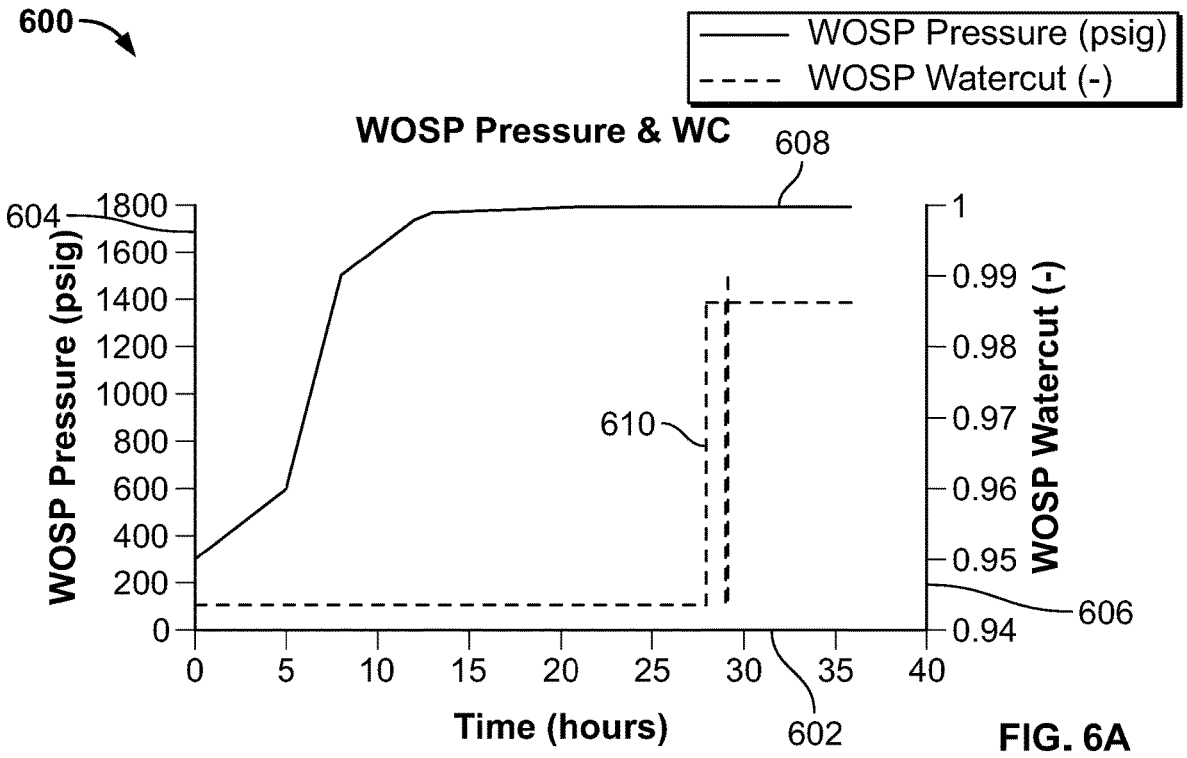
FIGS. 6A-6B are graphs that illustrate a water disposal process according to the present disclosure.
Figure 6B:
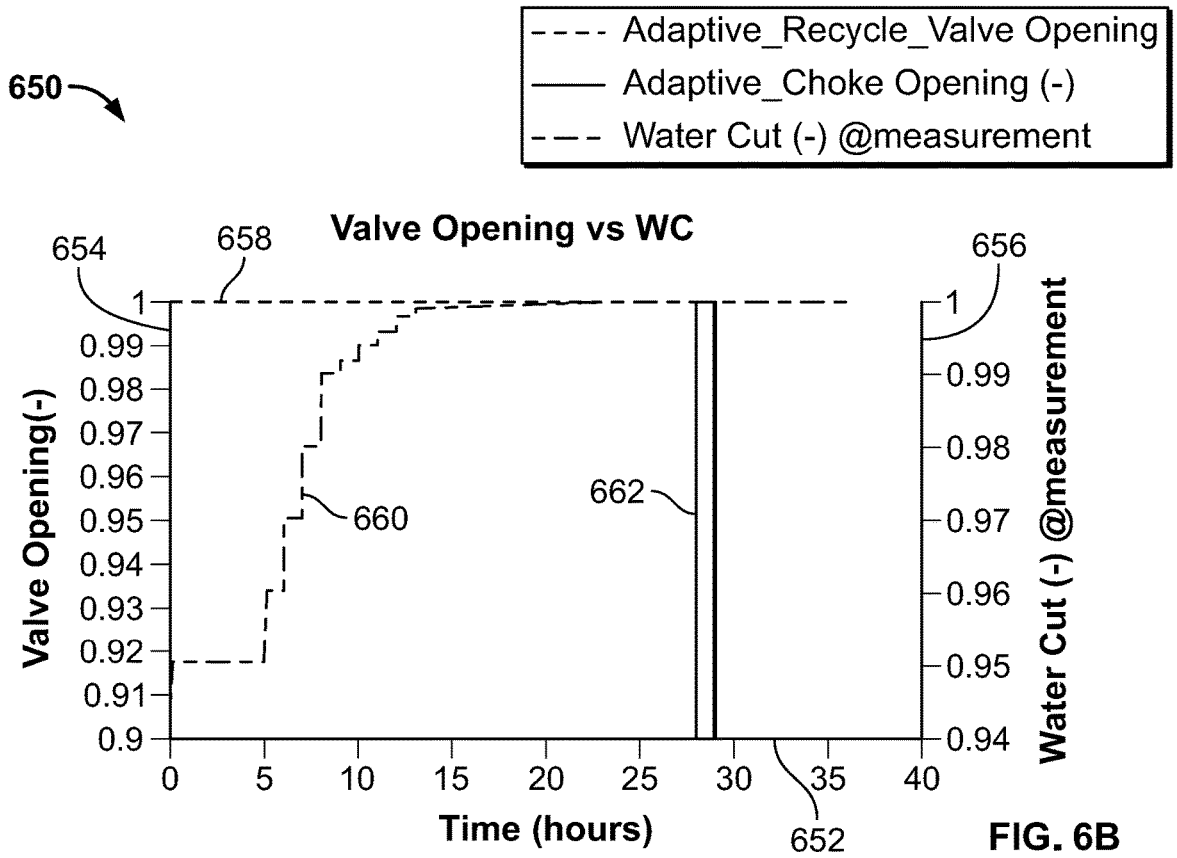

FIGS. 6A-6B are graphs that illustrate a water disposal process of the model 500 according to the present disclosure. FIG. 6A shows graph 600 that includes an x-axis 602 of time (in hours), a y-axis 604 of WSOP pressure in psig, and a y-axis 606 of WOSP water cut as a dimensionless number between 0 and 1. Curve 608 shows the WOSP water cut from 0 to approximately 35 hours. Curve 610 shows the WOSP pressure from 0 to approximately 35 hours.

FIG. 6B shows graph 650 that includes an x-axis 652 of time (in hours), a y-axis 654 of valve opening as a percentage between 0 and 1, and y-axis 656 of water cut as a dimensionless number between 0 and 1. Curve 658 shows the opening percentage of the adaptive recycle valve from 0 to approximately 35 hours. Curve 660 shows the water cut from 0 to approximately 35 hours. Curve 662 shows the opening percentage of the adaptive choke valve from 0 to approximately 35 hours. Thus, the OLGA transient model 500 offers enhanced proportions to the model 400's steady-state model by forecasting time dependent dynamics of the system, such as operational changes, oil-in-water concentration variations, temperature changes, fluid compositions changes, with flow rate variations.

Figure 8:
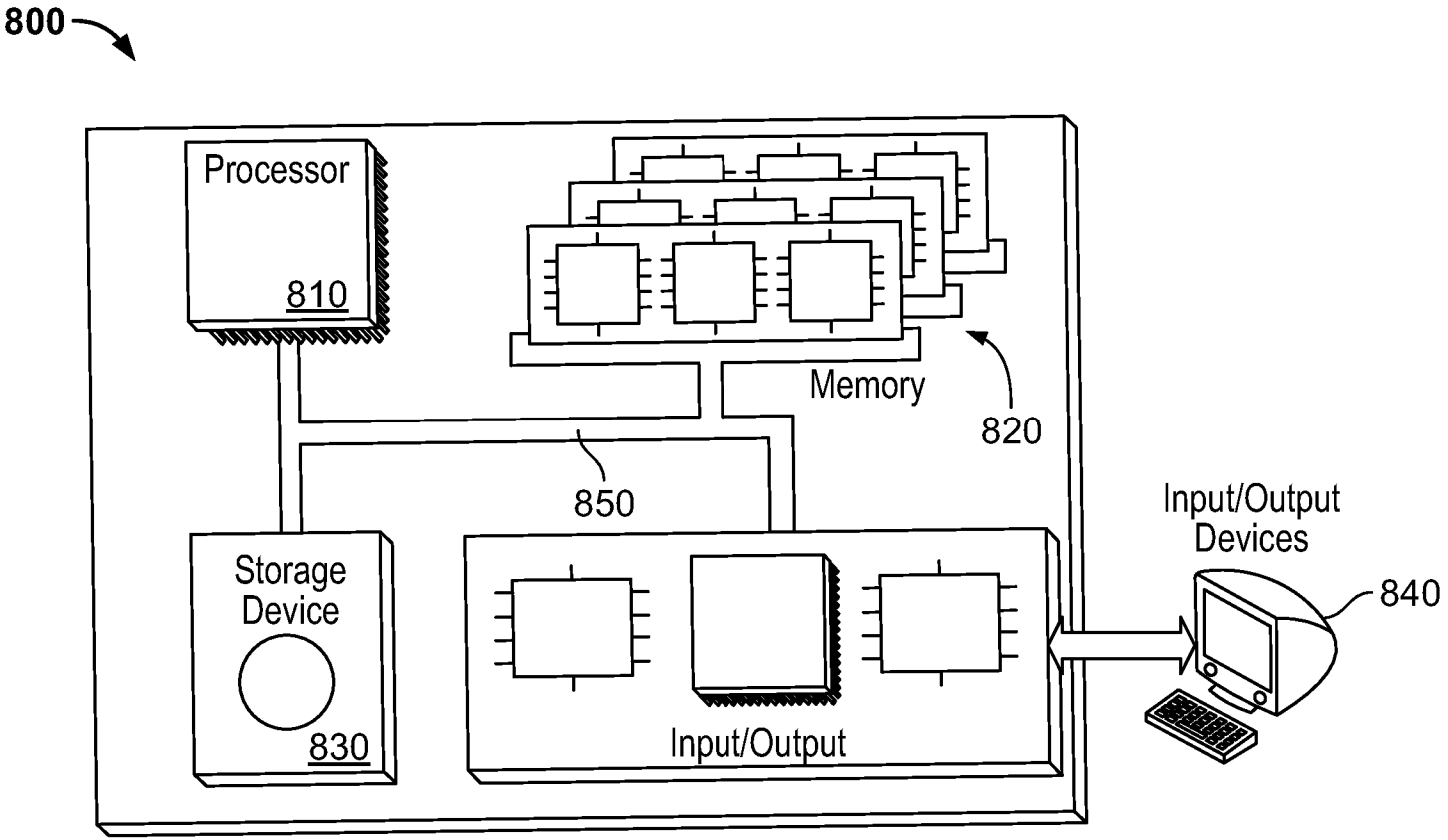
FIG. 8 is a schematic illustration of a controller or control system for managing water injected into a disposal well according to the present disclosure.

FIG. 8 is a schematic illustration of an example controller 800 (or control system) for managing water injected into a disposal well. For example, the controller 800 can be used for the operations described previously, for example as or as part of the ESD 136.

The controller 800 is intended to include various forms of digital computers, such as printed circuit boards (PCB), processors, digital circuitry, or otherwise that is part of a vehicle. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 800 includes a processor 810, a memory 820, a storage device 830, and an input/output device 840. Each of the components 810, 820, 830, and 840 are interconnected using a system bus 850. The processor 810 is capable of processing instructions for execution within the controller 800. The processor may be designed using any of a number of architectures. For example, the processor 810 may be a CISC (Complex Instruction Set Computers) processor, a RISC (Reduced Instruction Set Computer) processor, or a MISC (Minimal Instruction Set Computer) processor.

In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the controller 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the controller 800. In one implementation, the storage device 830 is a computer-readable medium. In various different implementations, the storage device 830 may be a floppy disk device, a hard disk device, an optical disk device, a tape device, flash memory, a solid-state device (SSD), or a combination thereof.

The input/output device 840 provides input/output operations for the controller 800. In one implementation, the input/output device 840 includes a keyboard and/or pointing device. In another implementation, the input/output device 840 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A water disposal system, comprising:

a piping circuit configured to circulate a mixed water-oil liquid from a water-oil separation plant to at least one water disposal well, the at least one water disposal well comprising a wellbore formed from a terranean surface to a subterranean formation;

an oil-in-water (OIW) meter positioned in the piping circuit between the water-oil separation plant and the at least one water disposal well;

at least one recycle valve positioned in the piping circuit downstream of the OIW meter;

at least one choke valve positioned in the piping circuit between the OIW meter and a wellhead of the at least one water disposal well;

at least one surface safety valve positioned at the wellhead; and a control system communicably coupled to the OIW meter, the at least one recycle valve, the at least one choke valve, and the at least one surface safety valve, the control system configured to perform operations comprising:

determining, based on a sampling of the mixed water-oil liquid by the OIW meter, an amount of oil in the mixed water-oil liquid;

based on the amount of oil being within a desired amount range, controlling each of the at least one choke valve and the at least one surface safety valve to modulate toward an open position or to maintain the open position, and controlling the at least one recycle valve to modulate to a closed position or to maintain the closed position; and based on the amount of oil being outside of the desired amount range, controlling each of the at least one choke valve and the at least one surface safety valve to modulate toward a closed position or to maintain the closed position, and controlling the at least one recycle valve to modulate to an open position or to maintain the open position.

2. The water disposal system of claim 1, wherein the control system is configured to perform operations further comprising:

providing, to a supervisory control and data acquisition system of the water-oil separation plant, one or more signals representative of at least one of:

the determined amount of oil in the mixed water-oil liquid; or a position status of at least one of the at least one choke valve, the at least one surface safety valve, or the at least one recycle valve.

3. The water disposal system of claim 2, wherein the control system is configured to perform operations further comprising providing an alarm to the supervisory control and data acquisition system of the water-oil separation plant based on the determined amount of oil in the mixed water-oil liquid being outside of the desired amount range.

4. The water disposal system of claim 1, further comprising at least one pump fluidly coupled between the at least one recycle valve and the water-oil separation plant.

5. The water disposal system of claim 4, wherein the control system is configured to perform operations further comprising:

controlling the at least one pump to circulate the mixed water-oil liquid through the at least one recycle valve to the water-oil separation plant based on the at least one recycle valve modulated to the open position or maintained at the open position.

6. The water disposal system of claim 1, wherein the OIW meter is positioned within 100 meters of the water-oil separation plant.

7. The water disposal system of claim 1, wherein the open position is 100% open, and the closed position is 100% closed.

8. The water disposal system of claim 1, wherein the desired amount range is between 0% and 0.5% oil by volume in the mixed water-oil liquid.

9. A method for managing water disposal, comprising:

circulating a mixed water-oil liquid in a pipeline from a water-oil separation plant toward at least one water disposal well that comprises a wellbore formed from a terranean surface to a subterranean formation, the pipeline comprising an oil-in-water (OIW) meter positioned in the pipeline between the water-oil separation plant and the at least one water disposal well, at least one recycle valve positioned in the pipeline downstream of the OIW meter, at least one choke valve positioned in the pipeline between the OIW meter and a wellhead of the at least one water disposal well, and at least one surface safety valve positioned at the wellhead;

determining, based on a sampling of the mixed water-oil liquid by the OIW meter, an amount of oil in the mixed water-oil liquid;

based on the amount of oil being within a desired amount range:

controlling each of the at least one choke valve and the at least one surface safety valve to modulate toward an open position or to maintain the open position, and controlling the at least one recycle valve to modulate to a closed position or to maintain the closed position; and based on the amount of oil being outside of the desired amount range:

controlling each of the at least one choke valve and the at least one surface safety valve to modulate toward a closed position or to maintain the closed position, and controlling the at least one recycle valve to modulate to an open position or to maintain the open position.

10. The method of claim 9, further comprising:

providing, to a supervisory control and data acquisition system of the water-oil separation plant, one or more signals representative of at least one of:

the determined amount of oil in the mixed water-oil liquid; or a position status of at least one of the at least one choke valve, the at least one surface safety valve, or the at least one recycle valve.

11. The method of claim 10, further comprising providing an alarm to the supervisory control and data acquisition system of the water-oil separation plant based on the determined amount of oil in the mixed water-oil liquid being outside of the desired amount range.

12. The method of claim 9, further comprising controlling at least one pump fluidly coupled between the at least one recycle valve and the water-oil separation plant to circulate the mixed water-oil liquid from the at least one recycle valve to the water-oil separation plant based on the at least one recycle valve modulated to the open position or maintained at the open position.

13. The method of claim 9, wherein the OIW meter is positioned within 100 meters of the water-oil separation plant.

14. The method of claim 9, wherein the open position is 100% open, and the closed position is 100% closed.

15. The method of claim 9, wherein the desired amount range is between 0% and 0.5% oil by volume in the mixed water-oil liquid.

16. The method of claim 9, further comprising sampling the mixed water-oil liquid in the pipeline between the at least one recycle valve and the at least one choke valve.

17. A computer-implemented method, comprising:

identifying, with a computing system that comprises one or more hardware processors, a value of an amount of oil in a mixed water-oil liquid that is circulating from a water-oil separation plant to at least one disposal wellbore;

determining, with the computing system, that the value is within an acceptable range of values;

based on the determination that the value is within the acceptable range of values, operating, with the computing system, each of at least one choke valve and at least one surface safety valve to modulate toward an open position or to maintain the open position, and at least one recycle valve to modulate to a closed position or to maintain the closed position;

based on the determination that the value is within the acceptable range of values, operating, with the computing system, at least one pump to circulate the mixed water-oil liquid into the at least one disposal wellbore;

determining, with the computing system, that the value is outside of the acceptable range of values;

based on the determination that the value is outside of the acceptable range of values, operating, with the computing system, each of the at least one choke valve and the at least one surface safety valve to modulate toward a closed position or to maintain the closed position, and the at least one recycle valve to modulate to an open position or to maintain the open position; and based on the determination that the value is outside of the acceptable range of values, operating, with the computing system, at least one pump to circulate the mixed water-oil liquid from the at least one recycle valve to the water-oil separation plant.

18. The computer-implemented method of claim 17, wherein the open position is 100% open, and the closed position is 100% closed.

19. The computer-implemented method of claim 17, wherein the acceptable range is between 0% and 0.5% oil by volume in the mixed water-oil liquid.

20. The computer-implemented method of claim 17, further comprising operating, with the computing system, an oil-in-water (OIW) meter to sample the mixed water-oil liquid.

21. The computer-implemented method of claim 20, wherein the operating of the OIW meter is repeated periodically.

* * * * *